United States Patent [19]

Jay

[11] Patent Number: 4,588,229

[45] Date of Patent: May 13, 1986

[54] SEAT CUSHION

[75] Inventor: Eric C. Jay, Boulder, Colo.

[73] Assignee: Jay Medical, Ltd., Boulder, Colo.

[21] Appl. No.: 548,868

[22] PCT Filed: Mar. 4, 1983

[86] PCT No.: PCT/US83/00320

§ 371 Date: Oct. 13, 1983

§ 102(e) Date: Oct. 13, 1983

[87] PCT Pub. No.: WO83/03195

PCT Pub. Date: Sep. 29, 1983

Related U.S. Application Data

[63] Continuation-in-part of Ser. No. 358,634, Mar. 16, 1982.

[51] Int. Cl.[4] ..... A47C 7/02

[52] U.S. Cl. ..... 297/459; 5/450; 297/DIG. 1; 297/452

[58] Field of Search ..... 297/452, 458, 459, 218, 297/DIG. 1; 5/455, 456, 451, 431, 441, 449, 450, 497, 490, 481

[56] References Cited

U.S. PATENT DOCUMENTS

| | | | |
|---|---|---|---|
| 3,253,861 | 5/1966 | Howard | 5/449 X |
| 3,308,491 | 3/1967 | Spence | 5/450 |
| 3,463,547 | 8/1969 | Brennan et al. | 297/459 |
| 3,503,649 | 3/1970 | Johnson | 297/459 |
| 3,663,973 | 5/1972 | Spence | 5/451 X |
| 3,689,949 | 9/1972 | Weinstein et al. | 5/451 |
| 3,721,232 | 3/1973 | Trenchard | 5/458 |
| 3,787,908 | 1/1974 | Beck et al. | 5/451 |
| 3,858,379 | 1/1975 | Graves et al. | 5/450 |
| 4,312,087 | 1/1982 | De Geus | 5/490 |
| 4,382,306 | 5/1983 | Lickert | 5/441 |

FOREIGN PATENT DOCUMENTS

| | | | |
|---|---|---|---|
| 918227 | 9/1954 | Fed. Rep. of Germany | 5/455 |
| 439936 | 12/1935 | United Kingdom | 5/455 |

*Primary Examiner*—James T. McCall

*Attorney, Agent, or Firm*—Donald E. Egan

[57] ABSTRACT

The present invention relates to a seat cushion for the human body which comprises a pad comprising a flexible envelope containing a fluid filling material, which pad is adapted to be used in combination with a shaped tray. In the preferred embodiment, the envelope of the pad is an extensible elastomeric material or the upper surface of the pad comprises excess material, and the pad is partitioned or segmented to limit the flow of the fluid filling material in selected areas of the pad.

23 Claims, 6 Drawing Figures

SEAT CUSHION

This Application is a continuation-in-part of the U.S. Application Ser. No. 358,634 filed Mar. 16, 1982, now abandoned.

BRIEF DESCRIPTION OF THE INVENTION

The present invention relates to a seat cushion for the human body which comprises a pad comprising a flexible envelope containing a fluid filling material, which pad is adapted to be used in combination with a shaped tray. In the preferred embodiment, the envelope of the pad is an extensible elastomeric material and the pad is partitioned or segmented to limit the flow of the fluid filling material in selected areas of the pad.

BACKGROUND OF THE INVENTION

Patients who are immobilized for any number of reasons are prone to develop pressure sores at any point in the body wherein a load bearing bone of the body is adjacent to the underlying support structure. Pressure sores are defined as localized areas of necrotic tissue over bony prominences. Particularly susceptible to pressure sores are patients who are victims of stroke, hip fracture, spinal cord injury, and brain injury, as well as paraplegics, and geriatrics. The successful cure of pressure sores requires daily care and debridement for a period of many months. In some cases, surgical skin grafting is necessary. The apparent problems and costs of treating a single pressure sore are great and therefore prevention must be considered a prime factor.

It has been estimated, that when seated on a flat surface, up to 75% of a person's body weight is distributed over an area covering only four square inches. This is the area of the ischia or seat bones. For a person weighing 150 pounds, this means as much as 110 pounds pressure is distributed over four square inches, or over 25 pounds per square inch pressure. It is also estimated that the capillary blood pressure, when seated, is about 40 millimeters of mercury or about 0.8 pounds per square inch. If pressures higher than 40 millimeters or mercury are developed during sitting, it is obvious that flow of blood through the capillaries can be restricted, which produces a much higher probability of developing pressure sores or decubitis ulcers.

The prior art has attempted to relieve the occurance of pressure sores on the human body by supporting the human body on large bodies of liquid, to distribute the supporting force uniformly all over the supported body. These attempts have been successful to a limited extent. However, in order to provide for complete support, it is necessary to displace a weight of liquid equal to the weight of the body being supported. Consequently, such systems are very heavy and are difficult to employ even in beds. Moreover, such heavy liquid cushioning devices have been found difficult to manipulate by patients who utilize wheel chairs to afford them a reasonable degree of mobility and independence, particularly when it is necessary to fold a wheel chair up when it is transferred by automobile.

The prior art systems have disclosed the use of air bags and air tight envelopes which sometimes include a mass of compressible, resilient material to augment the support, see for example U.S. Pat. Nos. 1,332,933, 2,997,100, 3,870,450 and 4,005,236. Other systems have included elastomeric foams which are filled with liquids, see for example U.S. Pat. Nos. 3,611,455, 3,702,484 and 3,965,508. While both of the liquid and gas (air) systems have been successful to some extent in distributing the body load over a wider surface of the body, both suffer from inherent disadvantages. Those fluid filled systems which rely on air tight or water tight envelopes are subject to inadvertent punctures and deflation with the resulting loss of support. The systems based on the use of liquid fillings are invariably heavy and are difficult to use in a wheel chair or other ambulatory devices. Moreover, the systems which rely on air or other gas for support need frequent adjustment to compensate for temperature variations, pressure variations (such is caused by altitude changes) and the weight of the user.

In addition to the foregoing problems, the prior art seat cushions do not provide sitting stability or posture support to the user. Problems with seat stability are particularly critical with respect to wheelchair users. A cushion which provides a stable seating enhances the users ability to wheel and turn the chair by grasping the wheels, to get in and out of the chair, to reach the floor to pick up an object from the floor and other types of movements. A cushion which provokes non-stability or a fear of falling from the chair will inhibit the user's range of movement. However, a seat cushion which provides a stable and comfortable seat, will improve the user's equilibrium and sense of orientation.

Many of the prior art cushions which provide the best pressure distribution, such as those filled with liquid or with other fluids, are not longitudinally divided. Accordingly, when people lean to one side or the other, which is the usual tendency, the fluid moves away from the lower side and into the higher side of the cushion, exaggerating the tendency to lean. This results in the person not only leaning more on a fluid filled cushion than a solid cushion, but it creates a feeling of instability and a fear of leaning to one side because of the instability which is likely to follow.

The prior art seat cushions have also failed to effectively deal with the problem of slumping. The prior art devices have no provision to prevent the ischial tuberosities from the sliding forward, gradually, which results in slumping to the point where the person's posture becomes bad. The consequences of slumping include increased pressure on coccyx and, if carried to extreme, a tendency to slip off the cushion and possibly out of the sheet chair.

The seat cushions of the present invention overcome the foregoing problems as is more fully described below.

SUMMARY OF THE INVENTION

The present invention relates to seat cushions for human beings and more particularly to a pad comprising a flexible envelope containing a fluid filling material. Although the pad may be used by itself, on any surface, in the preferred embodiment the pad is used in combination with a relatively rigid tray which is shaped to build supporting pressure in the desired areas, and thus distribute the load of human body over a sufficiently wide area of the body being supported in order to avoid the formulation of pressure sores.

In the preferred embodiment, the flexible envelope is longitudinally divided, or segmented by securing the upper surface of the envelope to the lower surface of the envelope from the front edge to the rear edge in order to prevent the fluid filling material from passing from one side to another. This construction avoids the problems associated with the person's leaning and provides substantially more supportive seat cushion.

In order to avoid the problem with hammocking, it is necessary that either the upper surface of the envelope be fabricated from an elastic material and/or the upper surface of the envelope be substantially wider than the width of the lower surface of the envelope and/or the upper surface of the accompanying tray. Hammocking is defined as a suspension of the bony prominences of the user on the surface of the cushion, thereby preventing total confirmation of the cushion to the user's body and preventing complete pressure equalization. The present invention contemplates the use of the elastomeric upper surface of the envelope, whereby the surface will stretch in response to pressure from the bony prominences, thereby distributing the pressure over a larger area. The other embodiment, wherein the upper surface of the envelope is substantially wider than the width of the lower layer, functions similarly in that pressure from the bony prominences will tend also to be distributed over a larger area. The present invention contemplates reduction of the hammocking problem by either the use of elastomeric material alone, or by using substantially wider upper surface alone or by using a combination of the two methods.

In one embodiment, the flexible envelope, adapted to contain the fluid filling material, is fabricated from an extensible elastomeric material, such as thermoplastic polyurethane film. The use of an elastomeric envelope and/or excess film minimizes the build up of pressures over bony prominences, and thus avoids the hammocking problem which is associated with inextensible supporting materials. The fluid filling material is preferably a high viscosity, thixatropic material which will flow under pressure, but which will maintain its shape in the absence of pressure.

The flexible envelope containing the fluid filling material is anchored to the underlying tray or chair in such a manner that it is restrained from sliding forward. This anti-sliding restraint, in combination with other seat design features described herein, reduces the tendency of the user to slide forward and the consequential slumping. Basically, through fastening the cushion, the tendency of the cushion to slip forward is obviated and the consequent tendency of the user to slump is substantially eliminated.

Moreover, the other features of the cushion also cooperate to reduce the tendency to slump. It is well known that slumping is a reaction to nonstability. An envelope filled with a non-compressible thixatropic filling produces a much more stable seat, which decreases the tendency toward slumping which occurs when a person is seated on an unstable surface. Moreover, in the preferred embodiment, the tray which has a slightly raised portion for the legs and a depressed portion for the ischial tubersities also has a marked tendency to reduce the tendency to slump, as the seat portion of the cushion is slightly lower than the leg portion in the preferred embodiment.

In the preferred embodiment, the pad, described above, is used in combination with a relatively rigid, shaped tray. The shaped tray has upwardly extending rims on both sides and a modified rim at the front (with areas to accommodate the legs of the user of the cushion), but the tray is open in the rear to avoid placing any pressure on the ischial tuberosities (seat bones) or the coccyx (tail bone), or the back during reclining. The opening in the rear should be at least six inches wide, and may extend across the entire width of the tray. Preferably the front rim is deep enough (as measured from front to back) to provide support for the user's legs and includes two areas of somewhat reduced elevation to accommodate user's legs. The rims of the tray function to generate supporting pressures, through the flowable filling material, in areas of the body other than the ischia or seat bones.

In this embodiment, it is preferred that the pad be removably attached to the tray along the rims at the sides and near the back. It is considered to be important to affix the pad to the tray at the back where there is no rim (in order to accommodate the tail bone) in order th avoid slippage of the pad off the ischia supporting area. It is contemplated that this system of attachement permits the pad to more uniformly distribute the supporting pressure across the user's entire bottom surface.

The use of a pad which is a separate component from the tray is desired for several reasons. The separate components allow the pad to be removed from cleaning and permits the pad to be used without the tray, such as in the operation of an automobile where the height created by the tray might tend to interfere with the steering wheel. Moreover, the use of a separable tray enhances the ability of the user to create a customized construction, wherein a portion of the tray can be cut away or built up. The separate component construction also provides for separate replacement in the event of damage.

In yet another embodiment, the pad is shaped to extend laterally beyond both sides of the tray near the back of the pad, so that when the pad is placed on the tray, it takes on a somewhat pleated appearance in the ischia supporting area. It has been found that the pleated pad conforms better to the bones, and when used is combination with the shaped tray provides for somewhat higher pressure along the sides of the user's body and thus distributes the user's weight on the cushion more evenly, as determined by relatively equal pressures measured across the user's bottom. This provides for comfortable support even for persons having bony protrusions from their ischia. The lateral extention may be confined to the upper surface of the envelope, although the present invention contemplates the extension of both the upper and lower surfaces. Although any amount of extension will provide some improvement, it is preferred that the upper surface be at least 25% wider than the width of the tray.

DETAILED DESCRIPTION OF THE INVENTION

Figure 1:
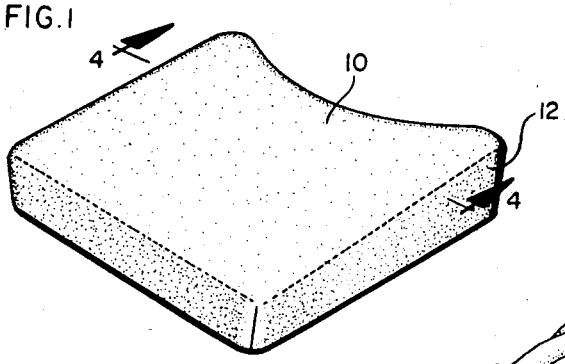
FIG. 1 is an isometric view of the seat cushion combination of the present invention illustrating the cushion with a cover thereover.

The seat cushion combination 10 is shown generally in FIG. 1. Removable cover 12 preferably comprises a stretchable fabric which expands to conform to any shape the pad may assume without increasing the sitting pressures. In the preferred embodiment, the cover is a stretchable fabric made from "Lycra" type fabric. Advantageously the cover is non-absorbent and readily washable.

Figure 4:
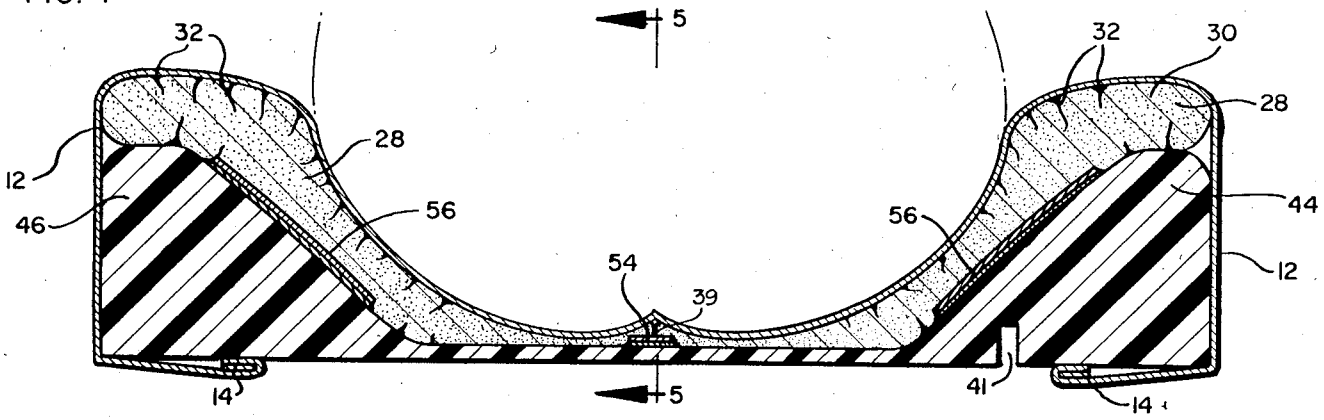
FIG. 4 is a cross sectional front view of the seat cushion combination taken at section 4—4 of FIG. 1.
Figure 5:
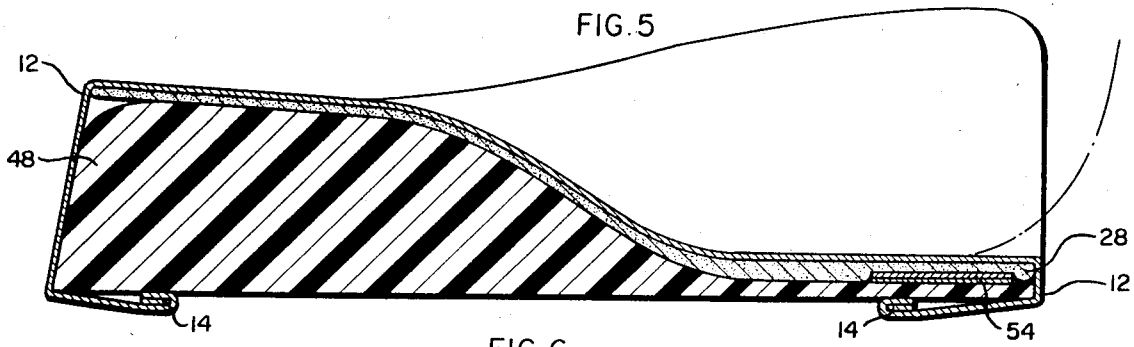
FIG. 5 is a cross sectional side view of the seat cushion combination taken at section 5—5 of FIG. 4.

In FIGS. 4 and 5, the cross-sectional views, the fitting mechanism of cover 12 is illustrated. Cover 12 fits over pad 20 and tray 40, and around the bottom of tray 40 where it is held in place by elastic strip 14. This construction permits ready removal of the cover for purposes of washing.

Figure 2:
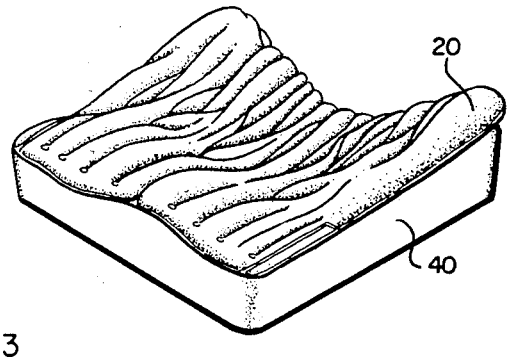
FIG. 2 is an isometric view of the seat cushion combination illustrating the pad in place and combined with the tray.

The combination seat cushion 10, without cover 12, is shown in FIG. 2. Seat cushion 10 is generally comprised of pad 20 and tray 40.

Figure 6:
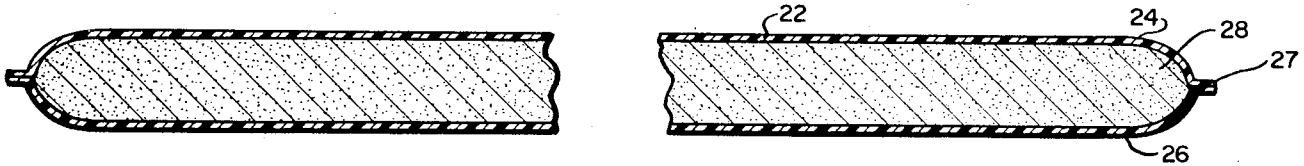
FIG. 6 is a cross sectional front view of the pad member, taken at section 6—6 of FIG. 3.

Pad 20, which is shown in section in FIG. 6, comprises an envelope 22 which may be constructed by two layers of flexible films 24 and 26, which envelope 22 is adapted to contain fluid filling material 28. Pad 20 and envelope 22 may be manufactured by heat-sealing flexible films 24 and 26 at the edges with heat seal 27 to contain the fluid 28 material therein, as is shown in FIG. 6. In the preferred embodiment the upper flexible film 24 is fabricated from an extensible, elastomeric material, such as a thermoplastic polyurethane.

THE ENVELOPE

The envelope 22 is adapted to contain the fluid filling material 28, and depending upon the nature of the fluid used, variations may be necessary to the composition or structure of the envelope. In the preferred embodiment wherein preferred FLOLITE® type of fluid is used, the envelope may be made of flexible sheets of thermoplastic film. It is essential that the envelope be flexible at ambient room temperatures and at temperatures of use. Desirably the envelope may be made of one or more layers or films of thermoplastic materials, such as thermoplastic polyurethane films.

In the preferred embodiment, it is essential that the upper film used as the envelope be an extensible elastomer so that it is readily stretchable under fairly light pressure, which avoids the hammocking problem described above. It is generally preferred to use a thermoplastic material having a 300% modulus no higher than about 1,800 psi with a tensile strength at break of at least 9,000 pounds. It has been found that envelopes produced from such materials in films of 5 mils thickness produced highly desirable, stretchable envelopes which avoid or minimize the hammocking problem encountered by the prior art, but which are strong enough to prevent accidental punctures.

It has also been found that two layers of 5 or 6 ml. polyurethane films, disposed parallel to one another, provide a surface which is readily pliable but which has great durability. Such double thickness films have been found useful when combined with thicker films for lower envelope surfaces. For example, it has been found that a good envelope is produced from two 6 ml. films as the upper surface and one 10 ml. film as the lower surface.

As was mentioned above, in the most preferred embodiment, it is preferred to have an excess of film or material in the upper surface of the envelope as compared to the overall surface of the tray or the width of the lower surface of the envelope. Basically, the presence of excess material in the upper film of the envelope obviates the hammocking problem and avoids the build-up of pressure points over the seat bones. Generally speaking, any excess material in the upper surface of the envelope will provide some reduction in hammocking, but it is desired that the overall width of material in the upper surface be at least 25% greater in width than the lower surface or the tray to which the envelope is attached. Obviously, the excess material in the upper surface of the envelope is adapted to cooperate with elastomeric upper surface to synergistically avoid the hammocking problem with the resulting pressure build-up points.

The envelopes used to produce the pads of the present invention are preferably heat sealable at the edges, and are adapted to retain the fluid filling material within a defined environment. It has been found that suitable thermoplastic polyurethane films have a thickness of about 0.004 to 0.015 inch and Durometer hardness (Shore A Scale) of 85 or lower. Commercially available polyurethane films have tensile strength in the range of 6,000–9,000 psi, a typical 300% modulus of 1,800 to 2,800 psi and a typical elongation at break of 400 to 650%. The two sheets of film 24 and 26 are connected by being securely heat-sealed together at 27, so as to seal and retain in place the fluid material 28 within the envelope enclosure formed between the sheets. The upper and lower films 24 and 26 may each be made up of plural layers of thermoplastic films or other materials, in order to improve strength, or heat-sealing or the like.

If desired, one may choose to first heat-seal the envelope for the fluid filling material, but leave a small vent opening and/or a small filling port (not shown), so that a predetermined amount or volume of fluid material (the fluid may be advantageously heated prior to injection) may be injected into the envelope enclosure through the filling port, followed by heat-sealing both the vent opening and filling port. Alternatively the envelope may be filled to a given level, and the ports used to increase or decrease the amount of fluid filling material.

THE FLUID FILLING MATERIAL

In its broadest aspect, the present invention contemplates use of any fluid material to fill the pad, as described above. However, it is preferred to employ as the fluid a highly viscous liquid, i.e., plastic or viscous thixotropic material, which flows gradually when pressure is applied to it, but which maintains its shape and position in the absence of pressure. One such viscous fluid is commercially available under the trade name FLOLITE®, the registered trademark of Alden Laboratories. Suitable flowable materials are described and claims in the U.S. patents listed below, which are incorporated by reference herein:

U.S. Pat. No. 3,237,319
U.S. Pat. No. 3,402,411
U.S. Pat. No. 3,635,849
U.S. Pat. No. 3,798,799
U.S. Pat. No. 4,038,762
U.S. Pat. No. 4,083,127
U.S. Pat. No. 4,108,928
U.S. Pat. No. 4,144,658
U.S. Pat. No. 4,229,546
U.S. Pat. No. 4,243,754

U.S. Pat. No. 4,255,202

In the preferred embodiment, at least the upper flexible film 24 is an extensible elastomer, e.g., it is produced from a polyurethane material having a 300% modulus of no greater than about 2,600 psi. Films having a tensile strength of at least 6,000 psi are strong enough to avoid accidental tears and punctures. When such a film is used in 5 mil thicknesses, it permits a highly desirable extensibility of the envelope which reduces the pressure over the bony prominences of the body and thus reduces the likelihood of pressure sores.

In the preferred embodiment, the pad 20 has lateral extensions 30 which extend outward from pad 20 and which are affixed on the rearward portion of the pad. Extensions 30 function to provide additional film for the envelope, in the form of rough pleats, and thus permit the user to avoid any hammocking problem. The lateral extensions 30 in extended form are clearly visible in FIG. 3 and the resulting pleats 32 are illustrated in FIG. 4. The pleated structure may obviate the need to use an elastomeric flexible film 24, in pad 20. In the preferred embodiment, an elastomeric film 24 is combined with the lateral extensions 30.

Figure 3:
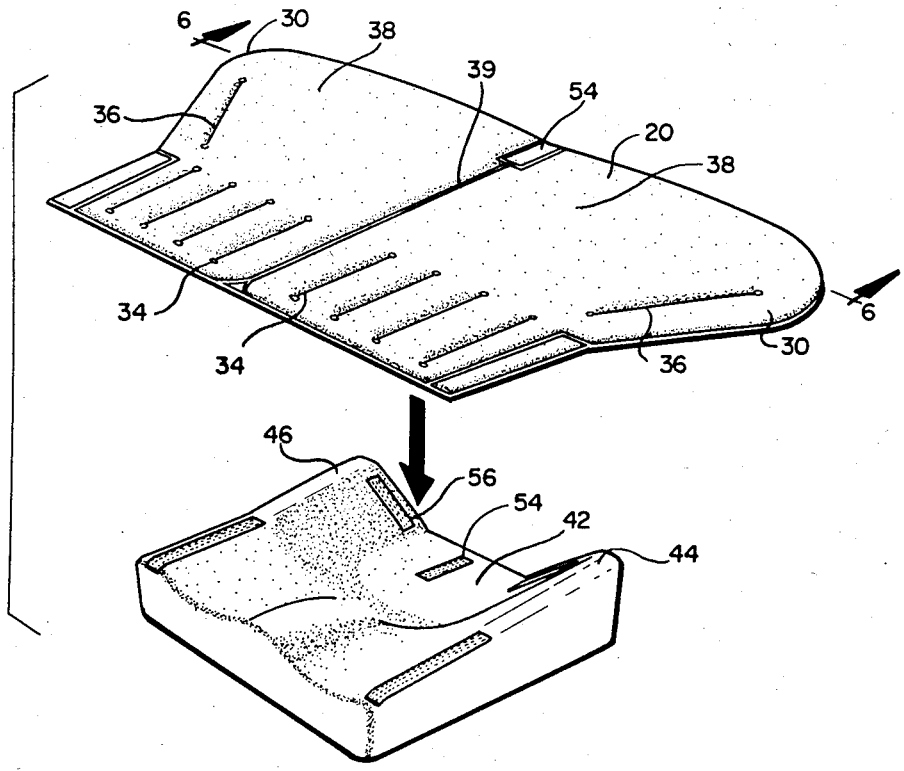
FIG. 3 is an isometric view of the seat cushion combination illustrating the pad separated from, but juxtaposed above, the shaped tray.

The extensions, as shown in FIG. 3 of the drawings, are fabricated by using wider films for both the upper and the lower surfaces of the envelope. It is contemplated that the extensions 30 may protrude 25% or more beyond the width of the tray. Alternatively, the envelope may be constructed with the lower surface more or less conforming to the width of tray or desired cushion area, and with the upper surface being wider than the width of the tray or the intended cushion area. This will provide an envelope with pleat-like wrinkles, similar to the configuration shown in FIG. 2.

In the preferred embodiment, the pad is segmented along the front by heat seals 34 and along the sides by heat seals 36. The segmenting heat seals 34 and 36 affix top film 24 to bottom film 26 in selected areas or at selected points. The segmenting accomplished by the heat seals function to limit the distance the top film 24 can move away from bottom film 24 in selected areas, and thus limits the volume of filling material which may flow into selected areas of the pad, and thus limits the overall thickness of the pad in selected areas. Because the segmenting functions to limit the amount of flowable filling material which may be contained in selected areas, the balance of the flowable filling material remains in the unsegmented sections of the 38 which are designed to support the ischia. As it is shown in FIG. 3, the front area of pad 20 includes a plurality of segmenting heat seals 34, which run from near the front of the pad, rearwardly and parallel to the direction of the user's legs. These segments define the area over which the user's legs pass. Because the legs cover a relatively limited area of the width of the front section of the pad, the segmenting caused by heat seals 34 limits the amount of flowable material which may move to the front of the pad, between and around the legs. This forces the balance of the flowable material to stay in the seat area 34, and thus reduces the possibility that the user will bottom-out.

Similarly, heat seals 36 at the sides segment the sides and prevents and undesirably great portion of flowable filling material from moving to the outside edge of the cushion. The segmenting of the pad reduces the volume of fluid filling necessary to avoid "bottoming-out" and thus reduces the weight of the complete seat cushion.

It is preferred to provide the pad 10 with a center heat seal 39 which runs from the front edge to the rear edge and which, in effect, divides the pad longitudinally into a left half and a right half. The center heat seal 39 avoids the possibility of the fluid filling material migrating out of one side (due to the user leaning to one side) and assures that both sides of the pad contain equal amounts of fluid filling material.

THE SHAPED TRAY

Tray 40 is preferably a relatively rigid, but light weight material. While urethane foams of various density have been employed, the tray could be manufactured from any convenient material such as plastic, wood, metal, or the like. It is generally desired to include a non-slip lower surface (not shown) and built in (e.g. molded) carrying handles 41. The tray must be wide enough to support a human being. Trays of about 15.5 inches or 18 inches width are suitable because they fit most persons and may be used in standard size wheel chairs. Smaller sizes, such as 12 inch or 14 inch widths may be fabricated for children. The invention is not limited to any specific size.

The shape of the tray 40 is critical. It is generally essential to have depressed, seat area 42 surrounded by rims 44 and 46 on each side and rim 48 on the front. A modified front rim 48 is preferably deeper, i.e.,(extends from a front edge approximately 40% of the distance of the back edge of the tray) with a central rise 50 adapted to spread the users legs and urge the users legs into support areas 52. It is essential that a rear portion of the tray be open, i.e., no rim at the back in order to avoid building pressure in the area of the coccyx. Because the distance between the ischial tuberosities in adults is between 4.5 and 6 inches, the cut out at the rear of the tray must be at least 6 inches wide, and is preferably at least 8 inches wide in order to provide for a certain amount of shifting from side to side of the user of the cushion. Generally it is desired that the person have from 1 to 3 inches room to shift from side to side and from 1 to 5 inches room to shift from front to back. This allows the user to shift position without developing any undesired pressures from the tray.

As shown in FIGS. 3 and 5, the side rims 44 and 46 are essentially vertical on the outside of tray 40, but ar sloped inwardly, generally toward the seat portion 42 on the inside of the tray. The sloping of the rims prevents the unchecked movement of the fluid filling material away from the body. Similarly, the front rim 48 is relatively vertical on the outside at tray 10, but slopes gradually inwardly and downwardly toward the seating area 43, on the inside of the tray. The inward sloping of side rims 44 and 46 combined with inward sloping of front rim 48 causes the main body of the flowable filling material to remain adjacent to seating area 42.

The arrangement of rims 44, 46 and 48 causes the flowable filling material to build up pressure along the sides of the user's body, as is shown in FIG. 5, and thus distribute the weight of the body over a large area wherein pressure developed is uniformly low.

The pad need not be attached to the tray, but attachment is preferred. Center attachment 54, which may be velcro, at the rear of the pad is desired in order to prevent the pad from slipping forward, as this may be the sole attachment means. Preferably the rear edge of the pad is also attached to the inward sloping portion of side rims with velcro strips 56. Strips 56 may also be used to, in effect, narrow the width of the lower film 26 of envelope 22; that is strips 58 may be used to hold the outer edge of envelope 22 adjacent to side rims 44 and thus cause a greater proportion of filling material 28 to be positioned in sitting area 42. This provides a certain amount of adjustability to the amount of flowable material in the sitting area and helps avoid the "bottoming-out" problem. The velcro strips, 56, also provide for some adjustment of the sitting height of the user.

ALTERNATE USES AND MODIFICATION

Although the foregoing discription has been oriented toward the fabrication of a seat cushion for human beings, it will be obvious to those skilled in the art that these concepts may be applied to other uses. For example, a pad of the type described above comprised of a flexible envelope containing a flowable filling material may be juxtaposed about a through-shaped tray and used as an orthopedic support, e.g., to support a leg being maintained in traction, so that the weight of the leg and any orthopedic devices suspended from the leg would be evenly distributed across the entire surface of the skin of the limb, and thus reduce the likelihood of pressure sores. Similarly, the device of the present invention may be modified to support other portions of the body wherein a pad overlies a shaped tray having rims designed to urge the flowable fluid toward the body part being supported, in order to build uniform pressure on the body and thus distribute the load of the body over a larger area.

The present invention contemplates the use of a layer of aluminum foil or other metal foil, adapted to transmit heat, over the surface of the tray. Such a foil layer is adapted to transmit the heat of the user's body away from the cushion area and thus avoid an undesired increase of body temperature in that area. The aluminum foil may be cooled externally to facilitate this function.

As was mentioned above, the pad may be designed to adjust the amount of fluid filling therein. Although adjustment of the amount of filling is not usually required when the fluid filling is a thixotropic type material, such as that sold under the trade name FLOLITE® but adjustment may be required if a gaseous fluid is employed to fill the pad.

The forms of invention shown and described herein are to be considered only as illustrative. It would be apparent to those skilled in the art that numerous modifications may be made therein without departing from the spirit of the invention or the scope of the appended claims.

What is claimed is:

1. A seat cushion adapted to support a human body against gravity while militating against the build up of pressure over bony prominences of the body comprising:

a pad juxtaposed over a relatively rigid, shaped tray, said pad comprising a flexible envelope comprising an upper surface, a lower surface, a front edge, and a rear edge, said envelope further containing a flowable fluid material, said upper surface being sealed to said lower surface from said front edge to said rear edge to longitudinally segment said envelope into a right half and a left half, said flowable fluid in each longitudinally segmented half being isolated from the other said segmented half of said envelope, said tray including a plurality of upwardly extending rims, said rims including inwardly sloped portions adapted to urge the fluid filling material downward and under the sides of the user of said cushion.

2. A seat cushion as described in claim 1 wherein the tray has an opening at its rear to accommodate the ischial tuberosities and coccyx of a user.

3. A seat cushion as described in claim 2 where the tray opening for the ischial tuberosities and coccyx is at least 2 inches wider than the user's ischial tuberosities.

4. A seat cushion as described in claim 2 wherein the tray has symmetrical side rims.

5. A seat cushion as described in claim 1 wherein the upper surface of the envelope of said pad is fabricated from an extensible elastomeric material.

6. A seat cushion as described in claim 1 wherein the upper surface of the envelope is wider than the width of the tray.

7. A seat cushion as described in claim 1 wherein said pad includes lateral extensions at both sides which extend beyond the rims of said tray.

8. A seat cushion as described in claim 6 wherein the upper surface of the envelope of said pad is at least 25% wider than the width of the tray.

9. A seat cushion as described in claim 1 wherein the pad is segmented adjacent to the front portion.

10. A seat cushion as described in claim 9 wherein the pad is segmented adjacent to the sides.

11. A seat cushion as described in claim 1 wherein the pad is filled with a high viscosity liquid material.

12. A seat cushion as described in claim 1 wherein said pad is filled with a thixatropic material.

13. A seat cushion adapted to support a human body against gravity while militating against the build up of pressure over bony prominences of the body comprising:

a pad, said pad comprising a flexible envelope comprising an upper surface, a lower surface, a front edge, and a rear edge, said envelope further containing a flowable fluid filling material, said upper surface being sealed to said lower surface from said front edge to said rear edge to longitudinally segment said envelope into a right half and a left half, said flowable fluid in each longitudinally segmented half being isolated from the other said segmented half of said envelope, said upper surface of said envelope further being fabricated from an extensible elastomeric material.

14. A seat cushion as described in claim 13 wherein the upper surface of the envelope of said pad is wider than the width of the lower surface.

15. A seat cushion as described in claim 14 wherein the upper surface of the envelope of said pad is at least 25% wider than the width of the lower surface.

16. A seat cushion as described in claim 13 wherein the pad is segmented adjacent to the front portion.

17. A seat as described in claim 13 wherein the pad is segmented adjacent to the sides.

18. A seat cushion as described in claim 13 wherein the pad is filled with a high viscosity liquid material.

19. A seat cushion as described in claim 13 wherein said pad is filled with a thixatropic material.

20. A seat cushion adapted to support a human body against gravity while militating against the build up of pressure over bony prominences of the body comprising:

a pad, said pad comprising a flexible envelope comprising an upper surface, a lower surface, a front edge, and a rear edge, said envelope further containing a flowable fluid filling material, said upper surface being sealed to said lower surface from said front edge to said rear edge to longitudinally segment said envelope into a right half and a left half, said flowable fluid material in each longitudinally segmented half being isolated from the other said segmented half of said envelope.

21. A seat cushion as described in claim 20 wherein the pad is filled with a high viscosity liquid material.

22. A seat cushion as described in claim 20 wherein the pad is filled with a thixatropic material.

23. A pressure compensating device adapted to support a human body, or portions thereof, against gravity while militating against the build up of pressure over bony prominences of the body comprising:

a pad juxtaposed over a relatively rigid shaped tray, said pad comprising a flexible envelope comprising an upper surface, a lower surface, a front edge and a rear edge, said envelope further containing a flowable fluid filling material, said upper surface being sealed to said lower surface from said front edge to said rear edge to longitudinally segment said envelope into a right half and a left half, said flowable fluid in each longitudinally segmented half being isolated from the other said segmented half of said envelope said tray including a plurality of upwardly extending rims, said rims including inwardly sloped portions adapted to urge the fluid filling material downward and under the sides of the body or body portions of the user of said pressure compensating device.

* * * * *